US006802626B2

(12) United States Patent
Belfer et al.

(10) Patent No.: US 6,802,626 B2
(45) Date of Patent: Oct. 12, 2004

(54) TRACK LIGHTING SYSTEM INCLUDING LAMP CLIPS WITH SEPARATE LOCKING AND CONNECTION MEANS

(75) Inventors: Bruce D. Belfer, Ocean, NJ (US); David Morgan, London (GB)

(73) Assignee: Lighting World Inc., Ocean, NJ (US)

( * ) Notice: Subject to any disclaimer, the term of this patent is extended or adjusted under 35 U.S.C. 154(b) by 3 days.

(21) Appl. No.: 10/159,843

(22) Filed: May 31, 2002

(65) Prior Publication Data

US 2003/0223232 A1 Dec. 4, 2003

(51) Int. Cl.[7] ..... F21V 21/34

(52) U.S. Cl. ..... 362/249; 362/219; 362/250; 362/287; 362/396; 439/111

(58) Field of Search ..... 362/145, 147, 362/219, 227, 249, 250, 287, 362, 368, 382, 391, 396, 404, 418, 429, 430, 217, 214; 439/111

(56) References Cited

U.S. PATENT DOCUMENTS

| | | | | | |
|---|---|---|---|---|---|
| 831,821 | A | * | 9/1906 | Beuttell | 362/219 |
| 4,158,221 | A | * | 6/1979 | Agabekov | 362/219 |
| 4,979,081 | A | * | 12/1990 | Leach et al. | 362/219 |
| 5,041,953 | A | * | 8/1991 | Dannatt | 362/219 |
| 5,180,887 | A | * | 1/1993 | Agabekov | 362/219 |
| 5,221,139 | A | * | 6/1993 | Belfer | 362/219 |
| 5,260,859 | A | * | 11/1993 | Lettenmayer | 362/219 |
| 5,785,411 | A | * | 7/1998 | Komai et al. | 362/219 |
| 6,273,587 | B1 | * | 8/2001 | Demshki | 362/219 |
| 6,435,696 | B1 | * | 8/2002 | Foottit | 362/219 |

* cited by examiner

*Primary Examiner*—Thomas M. Sember
*Assistant Examiner*—Ismael Negron
(74) *Attorney, Agent, or Firm*—Ezra Sutton

(57) ABSTRACT

A dual-voltage lighting fixture assembly having at least two independent lighting circuits for supporting and energizing tube-type lamps. The assembly comprises a track having an insulating housing for mounting at least one set of conductors along an upper plane surface of the housing and at least one other set of conductors along a lower plane surface of the housing. Sets of complementary tabs formed in the housing provide means for locking a plurality of lamp clips at predetermined positions on the track. An improved lamp clip includes means for connecting the lamp clip to the track and separate means for making electrical contact between the lamp and one of the conductors in the track. The lamp clip has corresponding apertures for receiving the complementary tabs in the track to lock the lamp clip in position, and an outwardly-extending tang integral with one side thereof for making electrical contact with the conductor. A low-profile track connector connects sections of track together end-to-end to form a track of variable length, wherein a continuous line of lamps can be maintained from one track section to the next without interruption at the point of connection.

35 Claims, 18 Drawing Sheets

TRACK LIGHTING SYSTEM INCLUDING LAMP CLIPS WITH SEPARATE LOCKING AND CONNECTION MEANS

FIELD OF THE INVENTION

The invention relates to a dual-circuit lighting fixture assembly having at least two independent lighting circuits for low-voltage lamps, which allows the length of track powered by one transformer to be substantially increased.

BACKGROUND OF THE INVENTION

Existing systems use a transformer connected to low-voltage track lights. The length of such tracks is limited by the amperage in the circuit provided by the transformer.

It is an object of the present invention to provide a lighting fixture assembly which substantially increases the length of such tracks connected to a transformer.

SUMMARY OF THE INVENTION

In accordance with the present invention, there is provided a dual-circuit lighting fixture assembly having at least two independent lighting circuits for supporting and energizing low-voltage lamps, such as 12 volts or 24 volts. The system includes one or more track sections, each having two sets of current-carrying conductors, a plurality of lamp clips locked in position on the track sections, the lamp clips making an electrical circuit between one of the conductors and the lamps, a track connector for connecting like track sections end-to-end to form a continuous lighting fixture assembly of variable length, and a power-feed connector to supply power from power-supply cables to the conductors.

The track sections each include an elongated insulating housing defining a plurality of conductor channels for mounting at least one set of conductors along an upper plane surface of the housing and at least one other set of conductors along a lower plane surface of the housing. The track section has a plurality of openings formed in the plane of the housing between the upper and the lower sets of conductors at predetermined locations along the length of the housing. Each opening has a pair of complementary tabs formed on the perimeter thereof, the tabs being spaced-apart and opposite one another to engage corresponding apertures of the lamp clip. A low-profile track connector connects sections of track together end-to-end to form a continuous line of track of variable length from one track section to the next without interruption at the point of connection.

An improved lamp clip is provided featuring simple construction, including mechanical means for attaching the lamp clip to the track sections and separate contact means for making electrical contact between the lamps and one of the conductors. The lamp clip includes a body member having first and second legs for supporting the lamp clip on the track and a pair of lamp-receiving sockets integrally connected to the legs, each socket for receiving the terminal end of a lamp. Formed from a single strip of spring steel or brass, the lamp clip provides an efficient electrical path between the conductors and the lamps. Each leg has an aperture for receiving the corresponding tab located on the track opening. When the tab engages this aperture, the leg of the lamp clip is locked in place on the track. One leg also includes at least one outwardly-extending tang attached thereto for making electrical contact with one of the conductors. In one embodiment of the present invention, the legs are equal in length, and the tang makes contact with one of the conductors in the upper plane of the housing.

DETAILED DESCRIPTION OF THE PREFERRED EMBODIMENT

Figure 1:
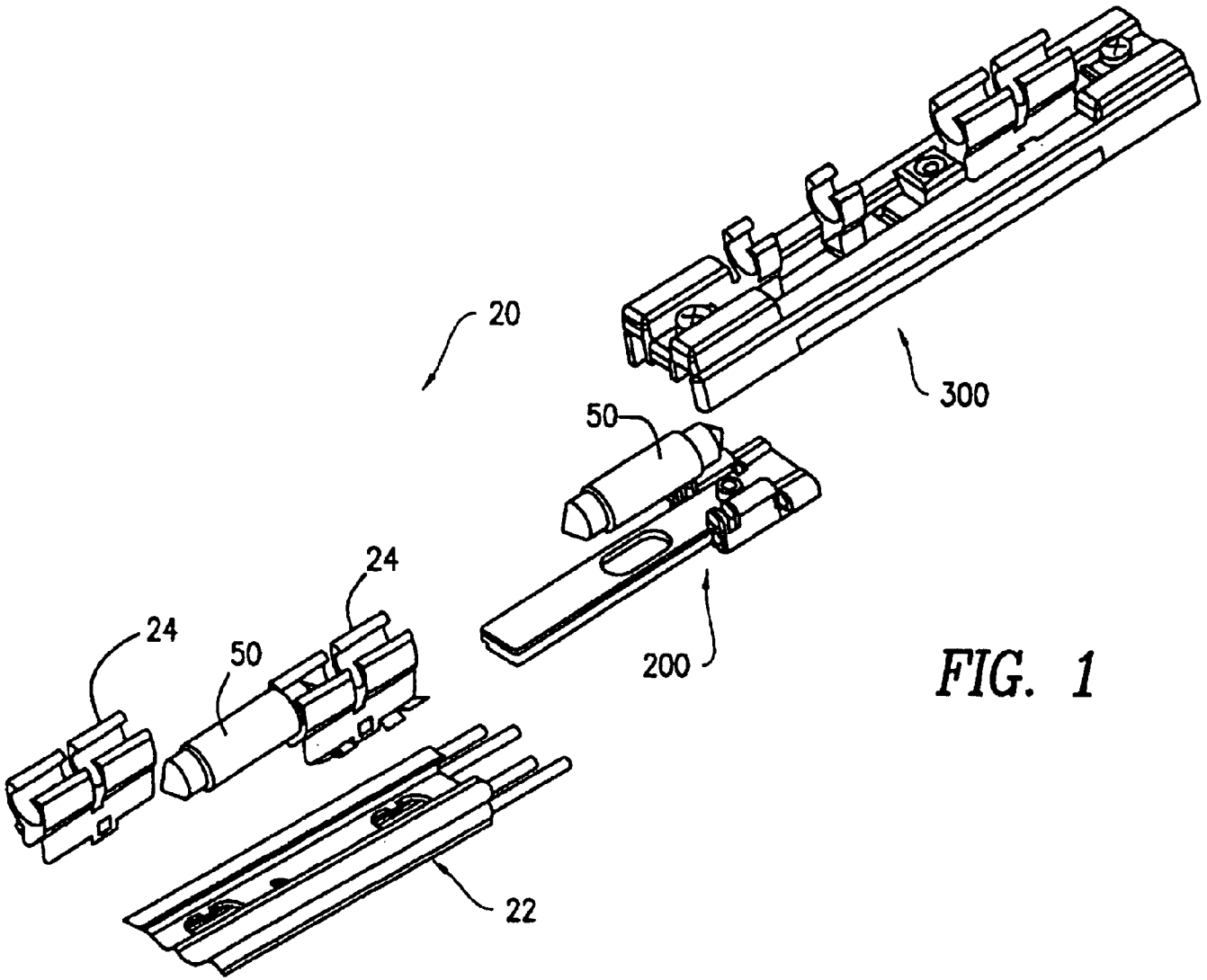
FIG. 1 is a perspective view of a lighting track assembly of the present invention.

Referring now to the drawings, where like elements are designated by like reference numerals, there is shown in FIG. 1 one track section 22 of a lighting track assembly 20 in accordance with the present invention for use with festoon lamps and other tube-type lamps and lighting fixtures. For example, the lamps may have rigid wire loops or may be LEDs. Different lamp clips may be used for different types of lamps, such as halogen, Xenon lamps, and new lamps that are developed.

Figure 2:
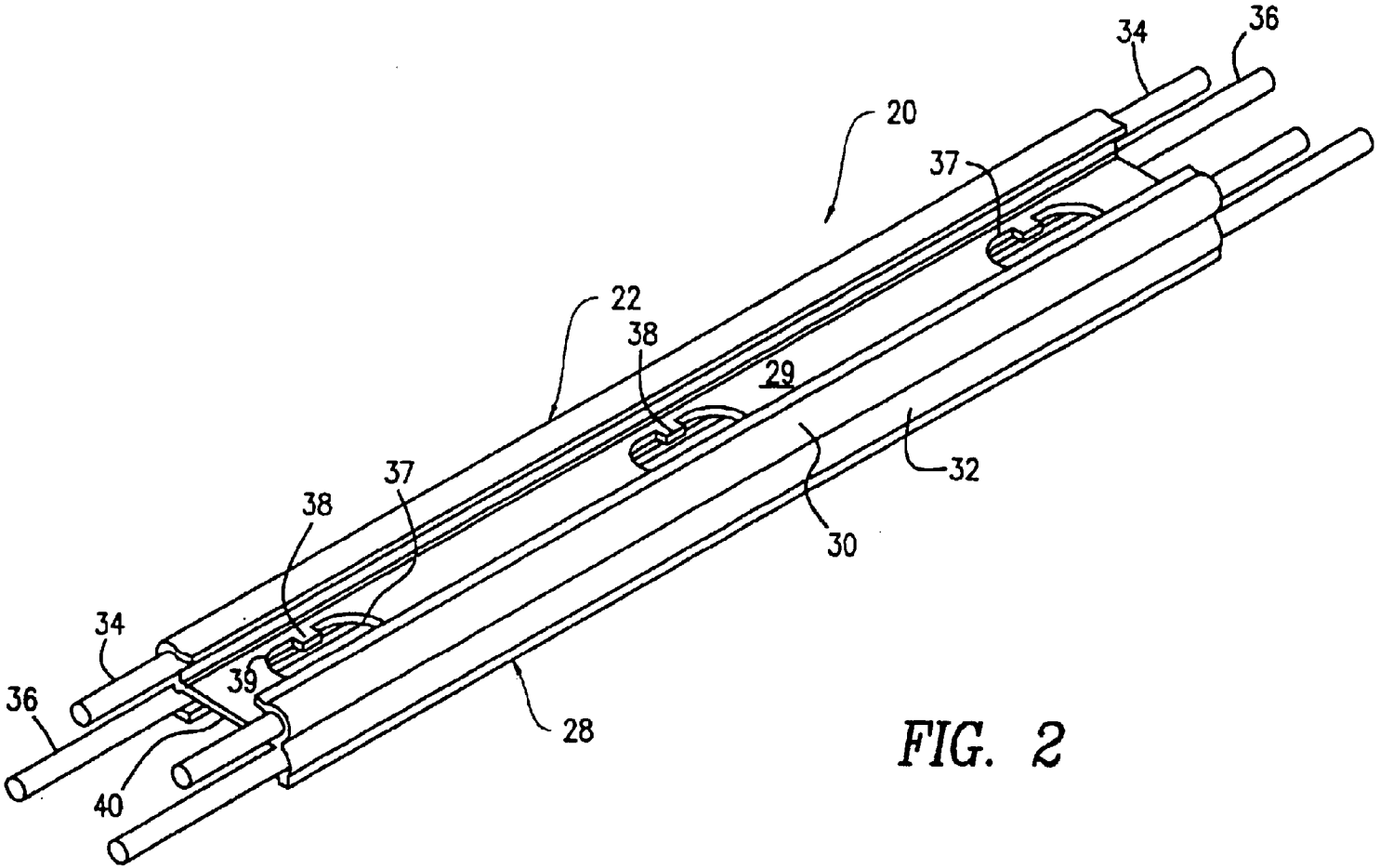
FIG. 2 is an enlarged perspective view of a track section.

The lighting track assembly 20 includes track sections 22, lamp clips 24 for receiving lamps, a base component 200, and a track connector 300. As seen in FIG. 2, the track section 22 comprises an elongated track housing 28 having a central portion 29, longitudinally inturned, spaced-apart edge portions 30 and 32 which form four channels for receiving four solid track conductors 34 and 36, and a plurality of apertures 37 at predetermined locations along the length of track housing 28. Generally, the spacing between adjacent apertures 37 is 2 inches (50.8 millimeters) or 3 inches (76.2 millimeters) on center, depending on the length of the lamp to be installed. Each aperture 37 includes a complementary pair of transverse mechanical tabs 38 formed on a perimeter 39 of the opening. Tabs 38 are formed in pairs, each tab being spaced apart and opposite one another to engage corresponding apertures of the lamp clip, in a manner that will be described below.

There is an imaginary axis 40 passing through central portion 29 for establishing a longitudinal plane of reference with respect to track section 22.

Figure 5:
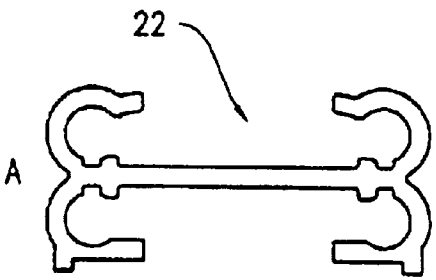
FIG. 5 is an end view of the track section.
Figure 4:
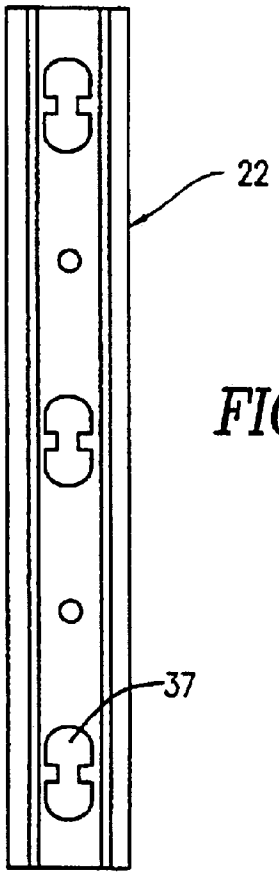
FIG. 4 is a top view of the track section.
Figure 3:
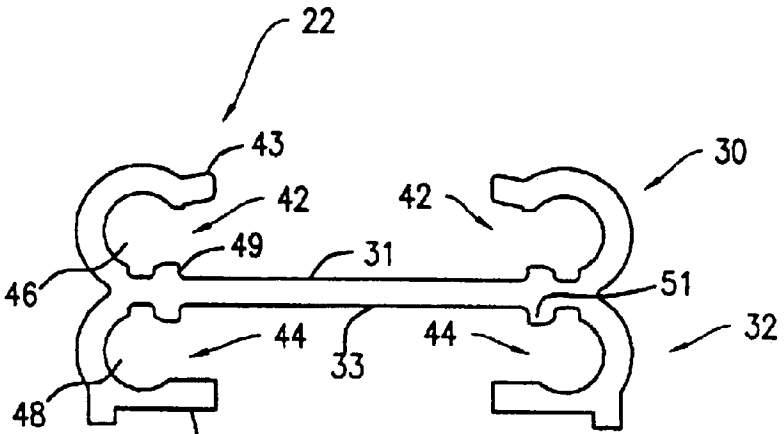
FIG. 3 is an enlarged end view of the track section.

Referring now to FIGS. 3 to 5, an enlarged end view of track section 22 is shown with edge portion 30 being essentially identical in size, shape, and structure to edge portion 32. The edge portions 30 and 32 each define a partially-cylindrical segment 42 above the longitudinal reference plane of track section 22 and a partially-cylindrical segment 44 below the reference plane. Segments 42 and 44 extend the length of track section 22 to form channels 46 and 48, respectively, in which the track conductors are installed.

Track section 22 includes a first set of track conductors 34 installed in channels 46 to form an electrical circuit above the longitudinal reference plane of track section 22 along an upper surface 31 of track housing 28. Track section 22 also includes a set of track conductors 36 installed in channels 48 to form a second electrical circuit below the longitudinal reference plane of track section 22 along a lower surface 33 of track housing 28. As can be seen in FIG. 2, track conductors 34 are shorter in length than track conductors 36.

It will be understood that track section 22 can be sized so that more channels can be provided on either the upper surface or the lower surface, or both surfaces, of the track housing 28 for installing extra sets of conductors to form additional electrical circuits.

Each of the segments 44 includes a strip 45 and a tab 47, both of which extend the length of the segment to form a base for mounting the track section 22 to a wall or ceiling surface.

There is a projection 49 extending outwardly from the upper surface 31 of track housing 28 towards the terminal edge 43 of segment 42. Similarly, there is a projection 51 extending outwardly from the lower surface 33 of track housing 28 towards strip 45. Projections 49 and 51 extend the length of track section 22 and, together with terminal edges 43 and strips 45, define openings 53 and 54 of channels 46 and 48, respectively. Openings 53 and 54 are slightly smaller in width than the outside diameter of track conductors 34 and 36 to provide a tight grip for holding the conductors in place when they are pressed into the channels.

Track housing 28 is manufactured by an extrusion process utilizing a die having a cavity with a shape conforming to the cross-sectional configuration shown in FIG. 3. The extruded housing is formed in lengths of 12 feet (3.658 meters). It can be cut to any desired length or joined end-to-end for longer lengths. Track housing 28 is flexible, both axially and transversely, with a minimum bend radius of 300 millimeters.

Figure 6A:
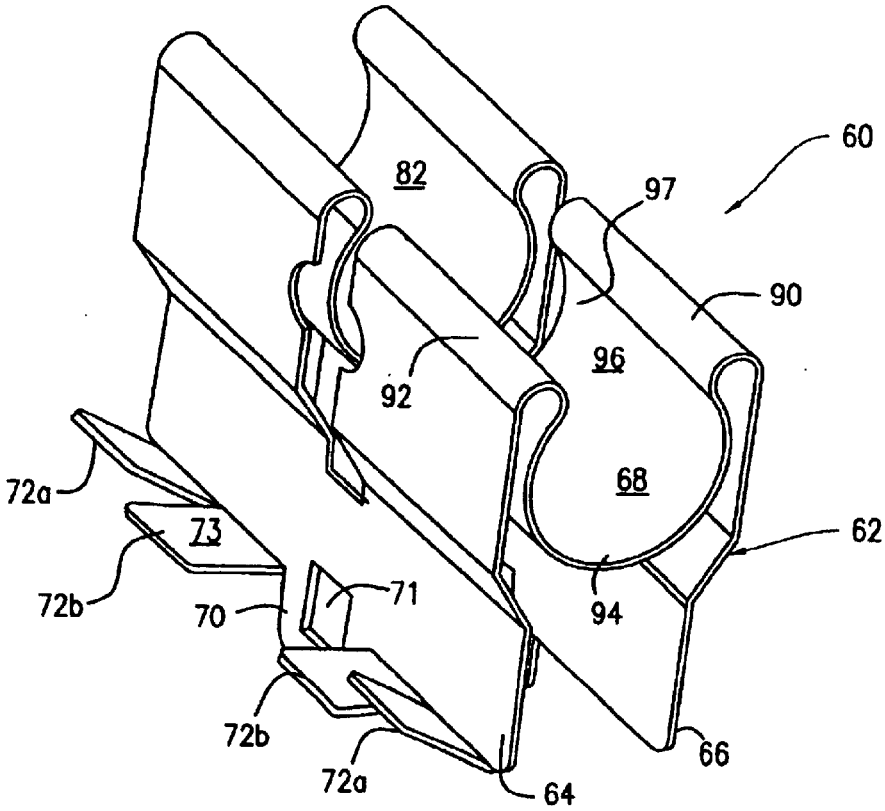
FIGS. 6A and 6B are enlarged perspective views showing the lamp clip.
Figure 6B:
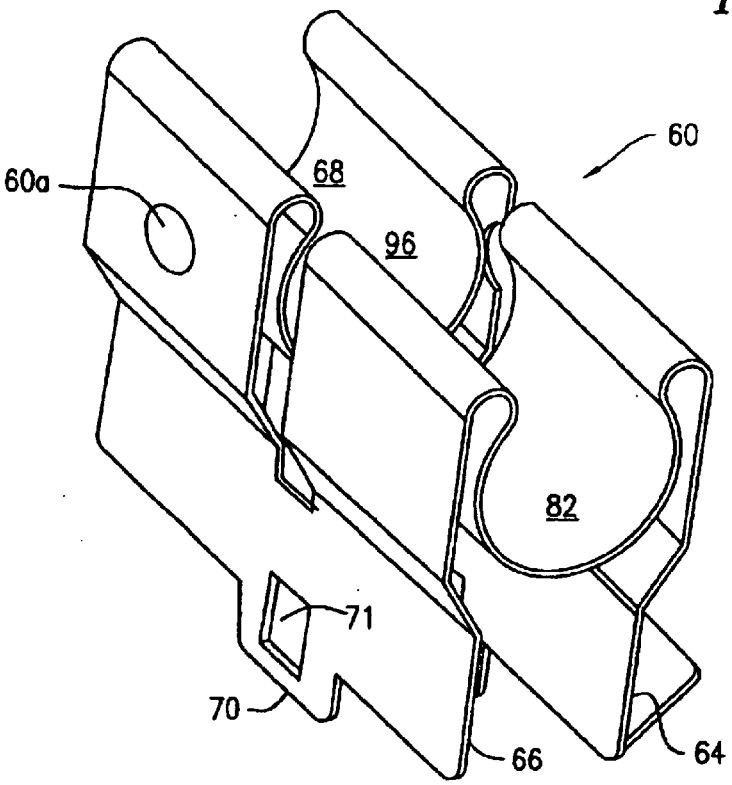

FIGS. 6A and 6B show front and back views of one embodiment of lamp clip 60 in accordance with the present invention. Lamp clip 60 includes a body 62, a first leg 64, a second leg 66, and a socket 68. The socket 68 is connected to an upper end of each of the first and second legs 64 and 66. The opposite or lower end of each leg is formed with an integral tab 70. Tab 70 includes an aperture 71, which is adapted to receive one of the set of complementary tabs 38 of track section 22, so that each leg 64 and 66 can be locked in position on the track 22 as tab 38 engages the aperture 71. Extending outwardly from leg 64 near its lower end, there are a pair of upper tangs 72*a* and a pair of lower tangs 72*b*, which are extensions of the leg folded away therefrom. Each tang 72 includes a surface 73 adapted for making electrical contact with the top and bottom of one of the upper conductors 34 of track section 22 to form an electrical path between this conductor and a lamp 50 installed in the lamp clip 60, as can be seen in FIG. 1. Although a pair of upper and lower tangs, spaced apart from each other, is preferred in order to insure upper and lower electrical contact in a variety of mounting positions, only one tang 72 is required to make the electrical contact. In addition, the clip 60 includes a hole 60*a* as a polarity indicator.

The lamp clip 60 is preferably formed of a resilient material, such as spring steel, which, in addition to its resiliency, has been found to be acceptable because of its electrical conductive properties.

It will be understood that socket 68 of lamp clip 60 is essentially identical to socket 82. Each socket 68, 82 is divided longitudinally into first and second gripping sections 90 and 92, respectively, and a third section 94 interposed between the gripping sections. Transverse slot 91 divides the first gripping section 90 from the third section 94, and transverse slot 93 divides the third section 94 from the second griping section 92. Gripping sections 90 and 92 each define a partially-cylindrical cavity 96 bounded by opposed gripping portions 97 and 98, which are dimensioned to accommodate a terminal end 52 of lamp 50. Cavity 96 is slightly smaller in width than the corresponding outside diameter of terminal end 52, so that sufficient spring tension is exerted on the end of the lamp as it is installed in the socket, thus ensuring a tight grip for a solid electrical connection. The transverse slots 91 and 93 permit the first and second gripping portions 90 and 92 to flex independently of each other, so that the lamp clip can receive at opposite ends two separate terminal ends of two adjacent bullet lamps, as shown in FIG. 1.

Figure 7A:
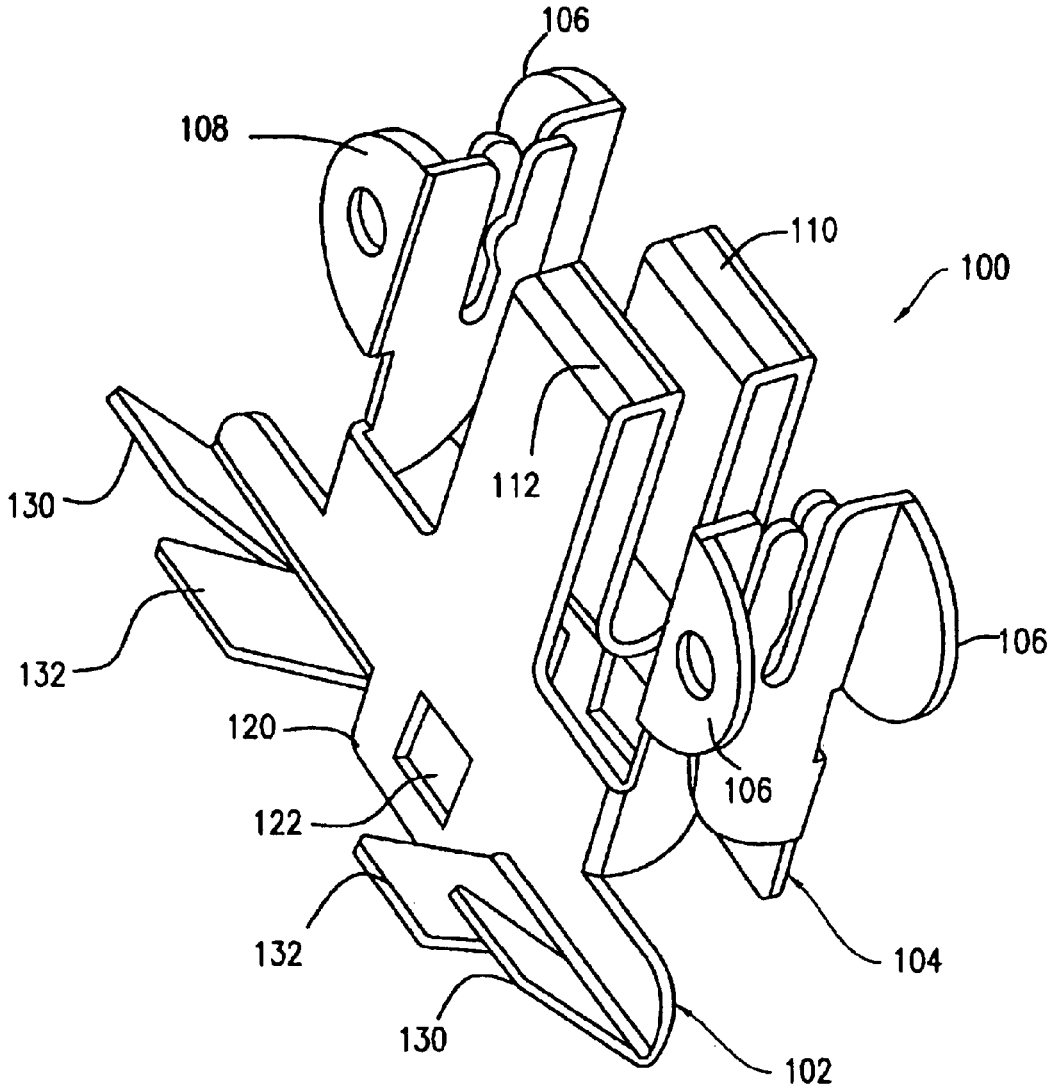
FIGS. 7A and 7B are enlarged perspective views showing the lamp clip.
Figure 7B:
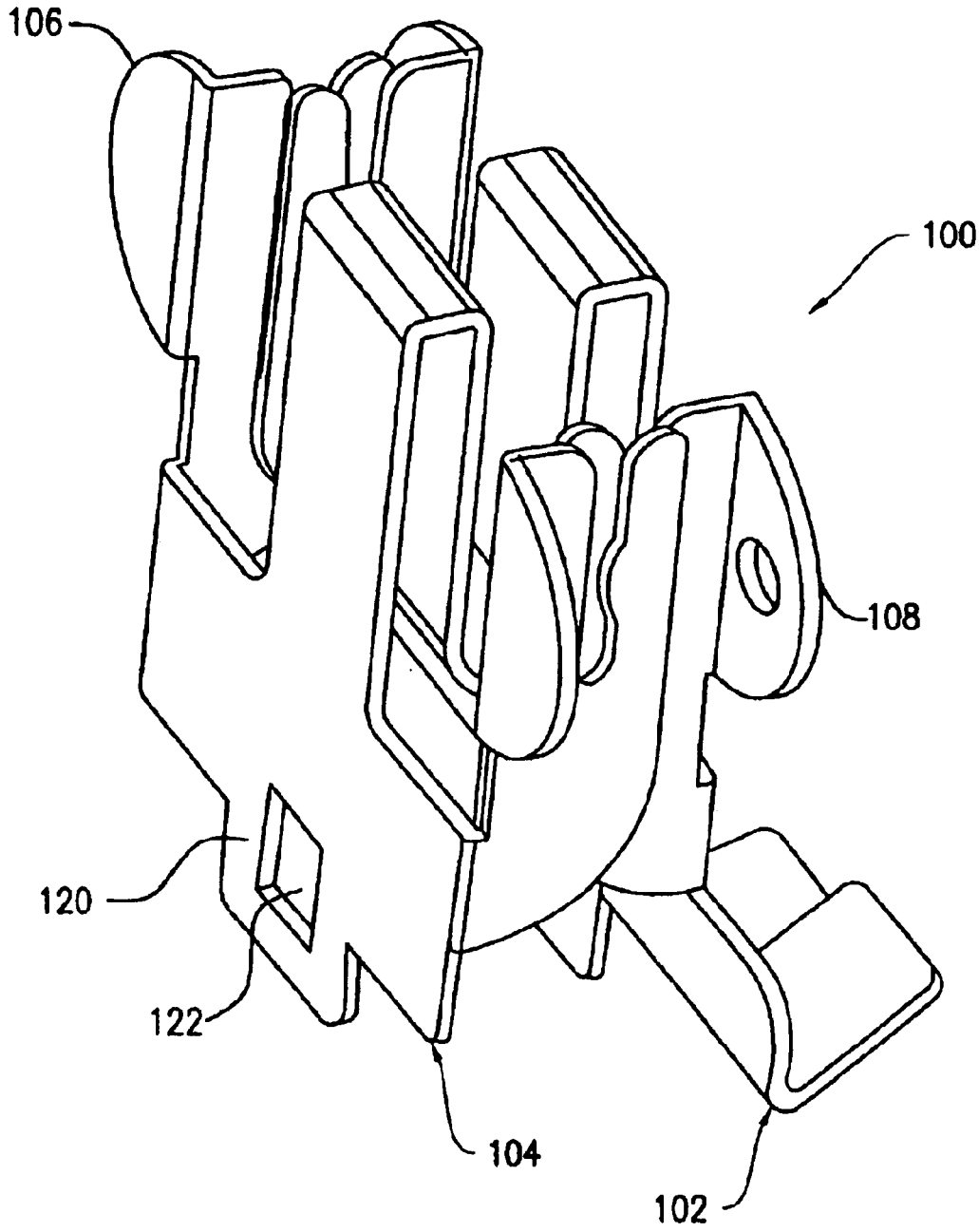
Figure 8:
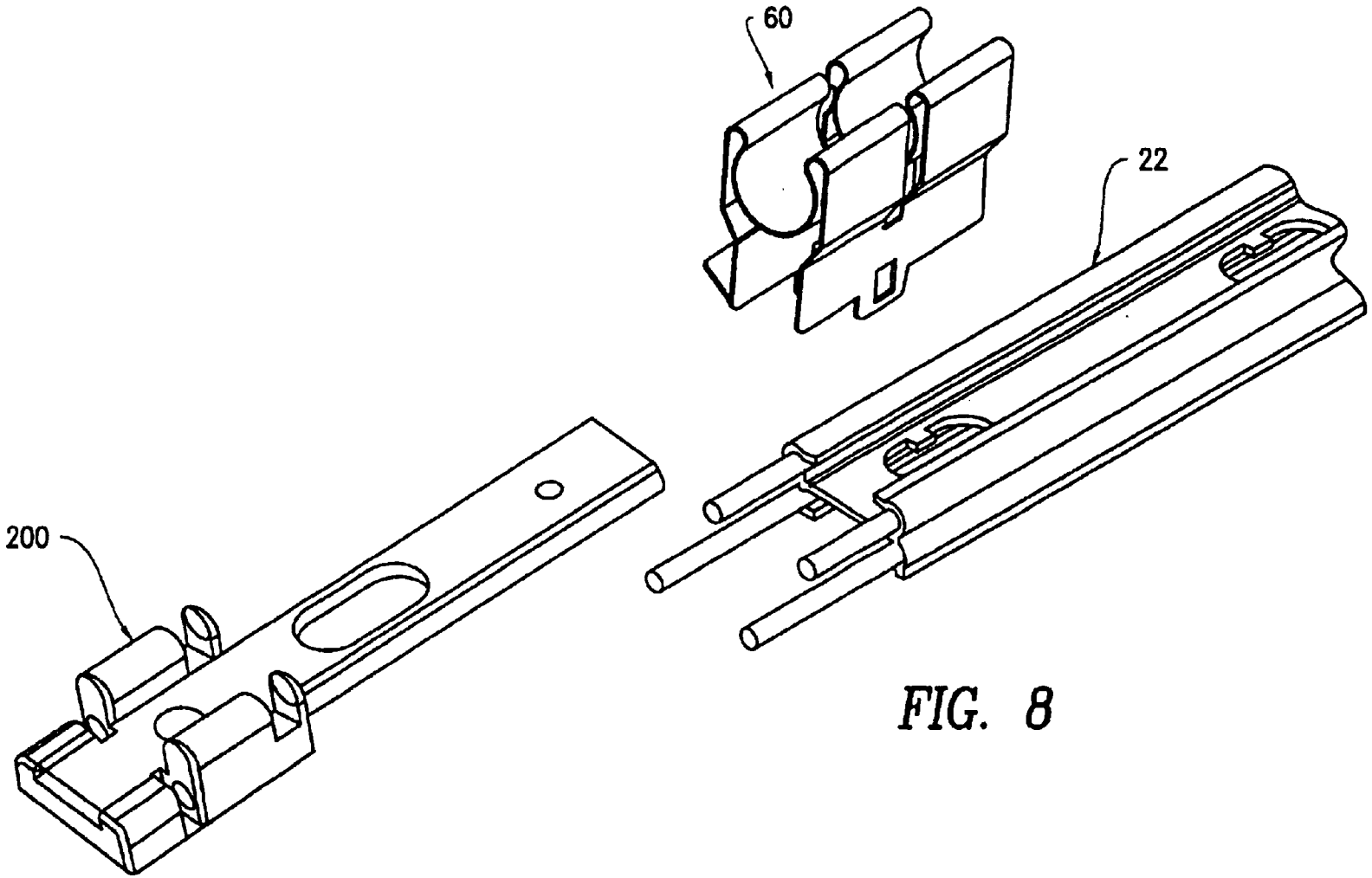
FIG. 8 is an enlarged view of the track section and the lamp clip.
Figure 9:
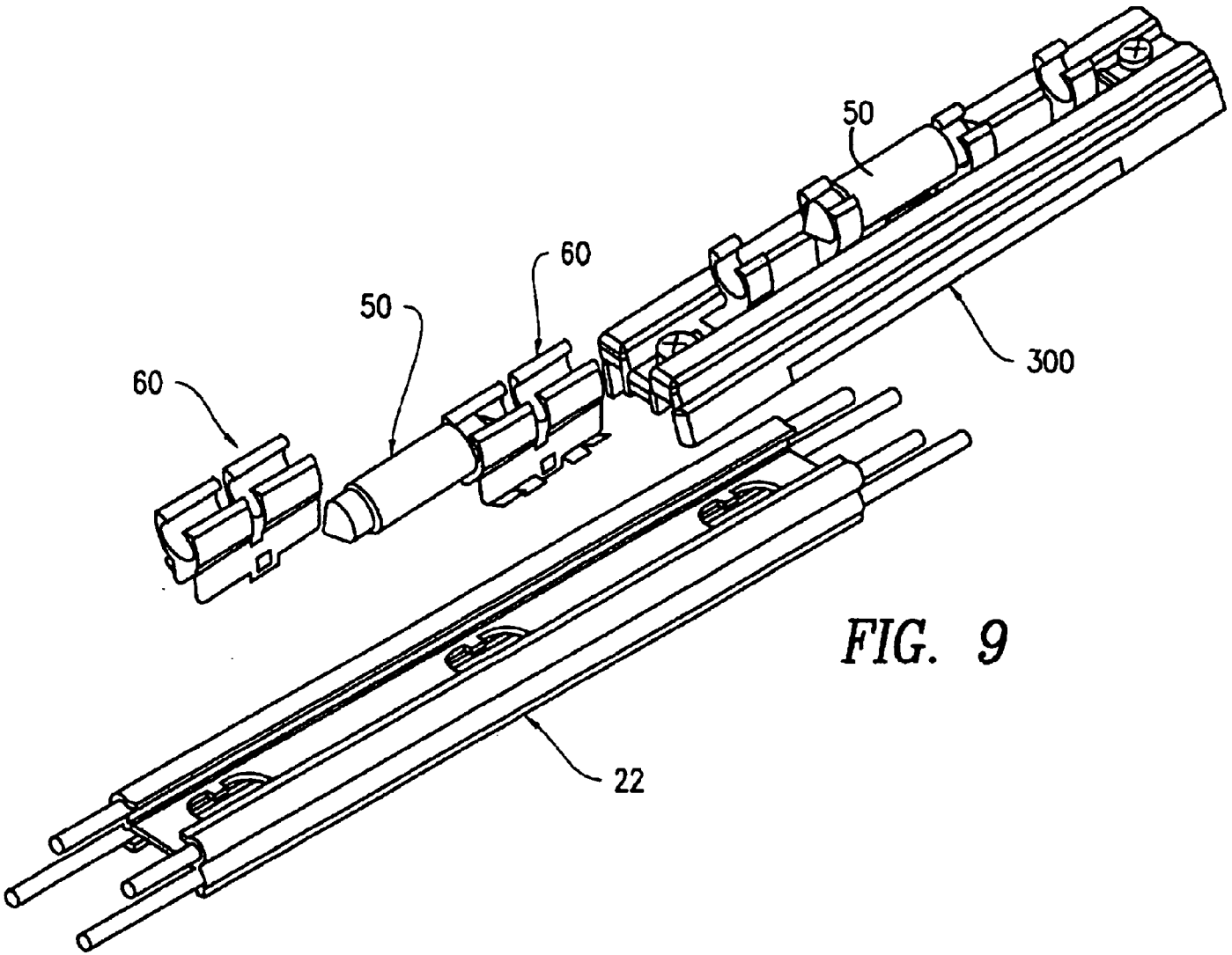
FIG. 9 is an enlarged partial view in perspective of connected sections.
Figure 10:
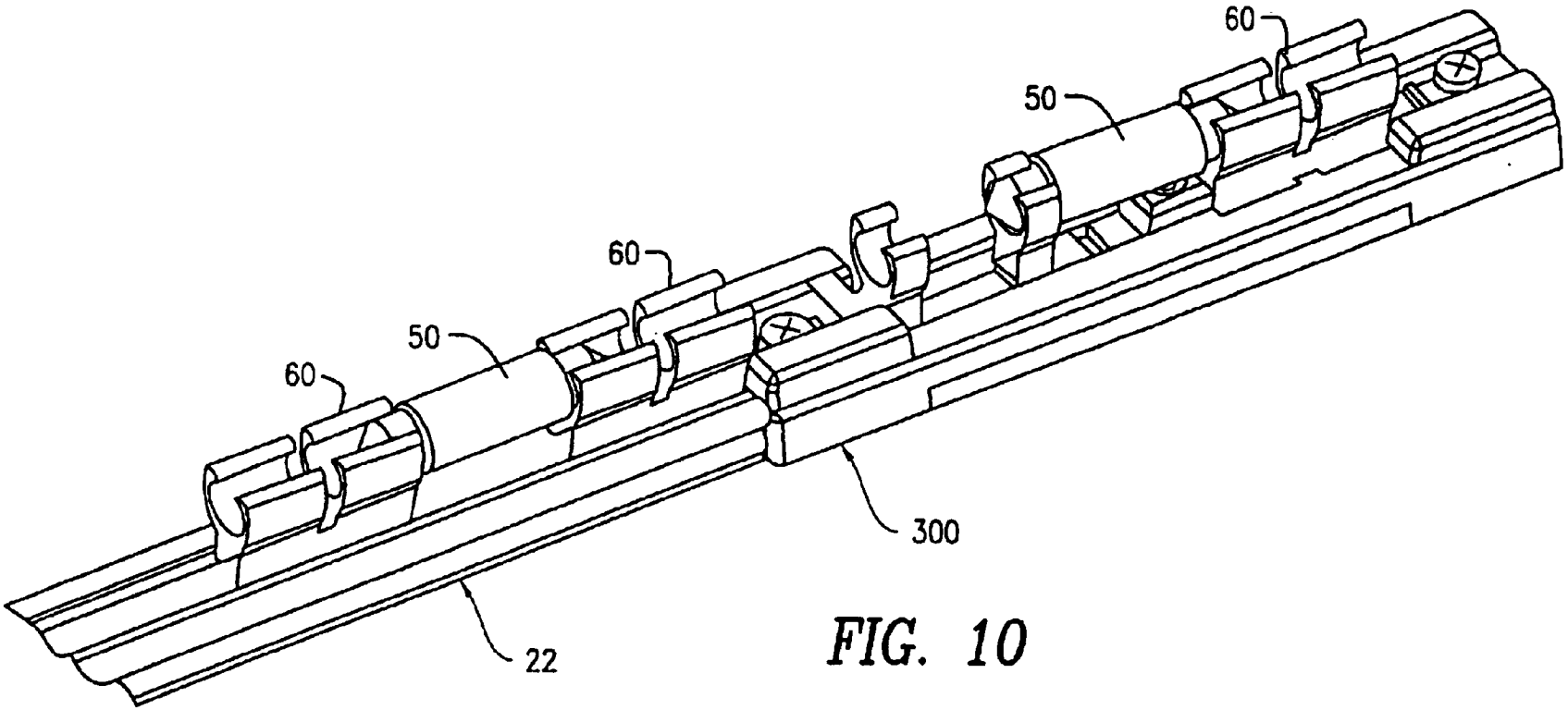
FIG. 10 is a view in perspective of the track connector.
Figure 11:
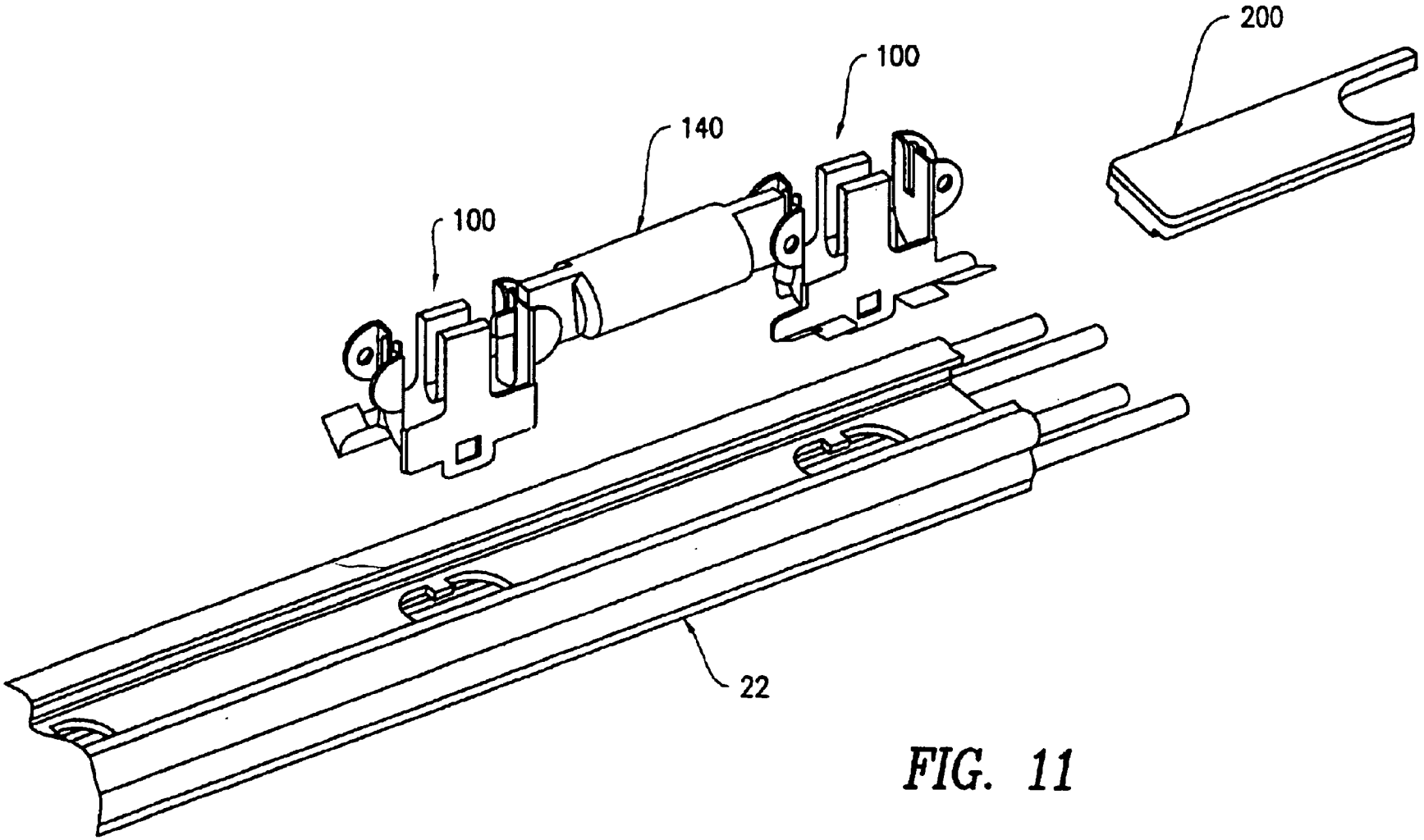
FIG. 11 is an enlarged partial view in perspective of a different lamp clip.

FIGS. 7A and 7B show an alternate lamp clip 100 for holding a wire loop lamp 140, having a first leg 102, a second leg 104, a first set of lamp-engaging ears 106, a second set of lamp-engaging ears 108, and spring sections 110 and 112. Tab 120 includes an aperture 122 for receiving tabs 38 of track section 22. Extending from leg 102 are a pair of upper tangs 130 and a pair of lower tangs 1*s*32 for making electrical contact with conductor 34.

Figure 12:
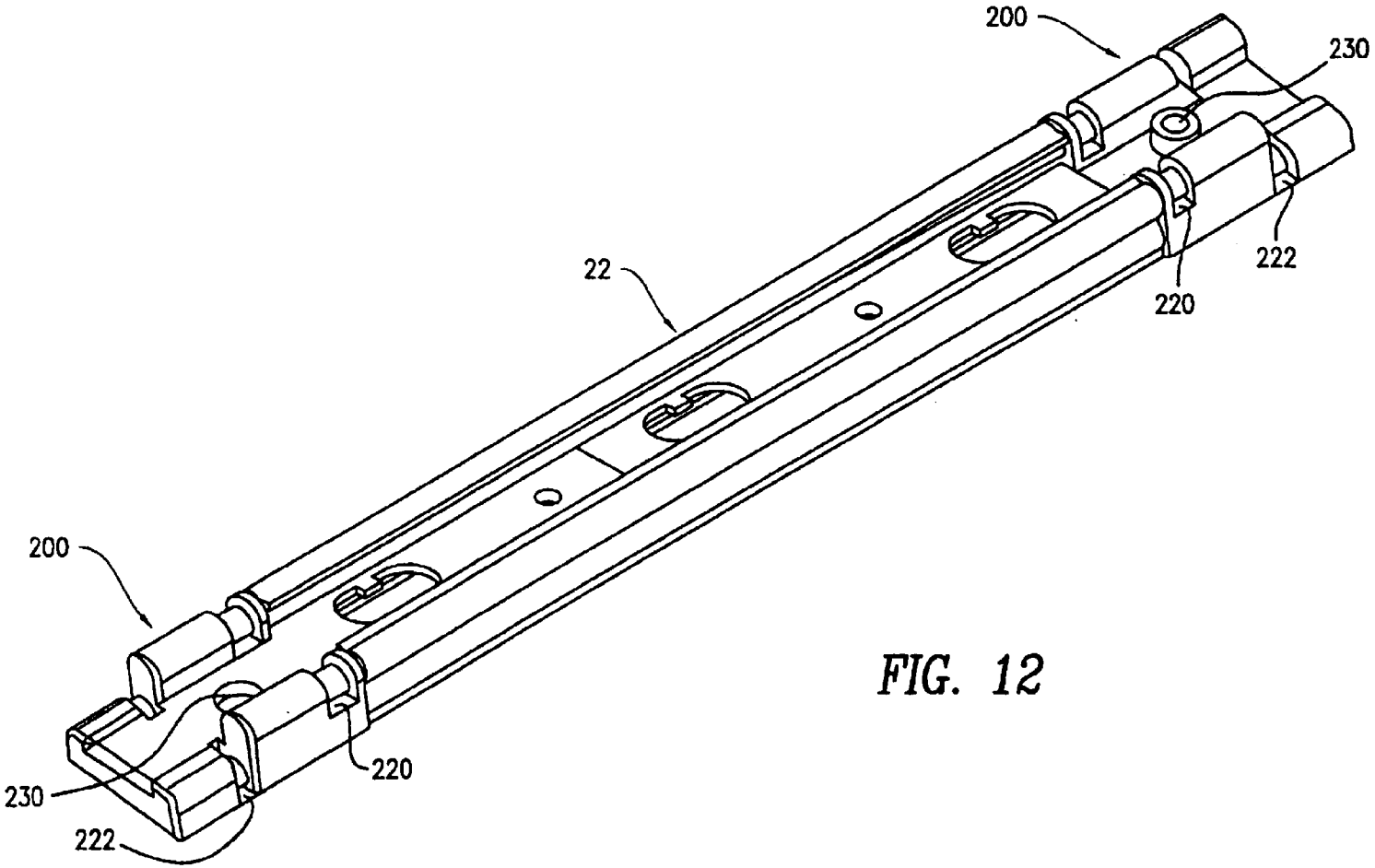
FIG. 12 is a track section.
Figure 13:
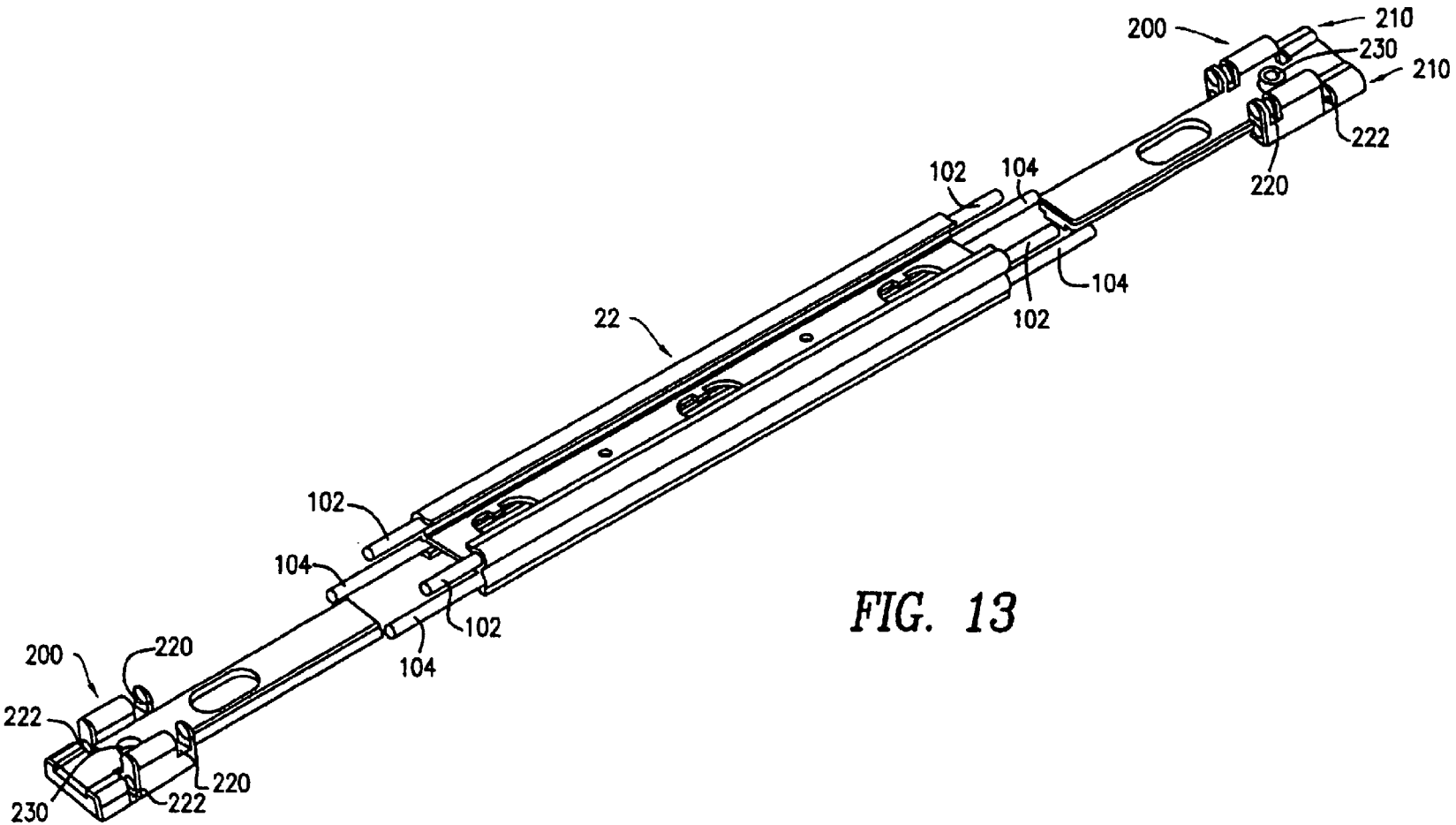
FIG. 13 is a track section joined with the base components.
Figure 14:
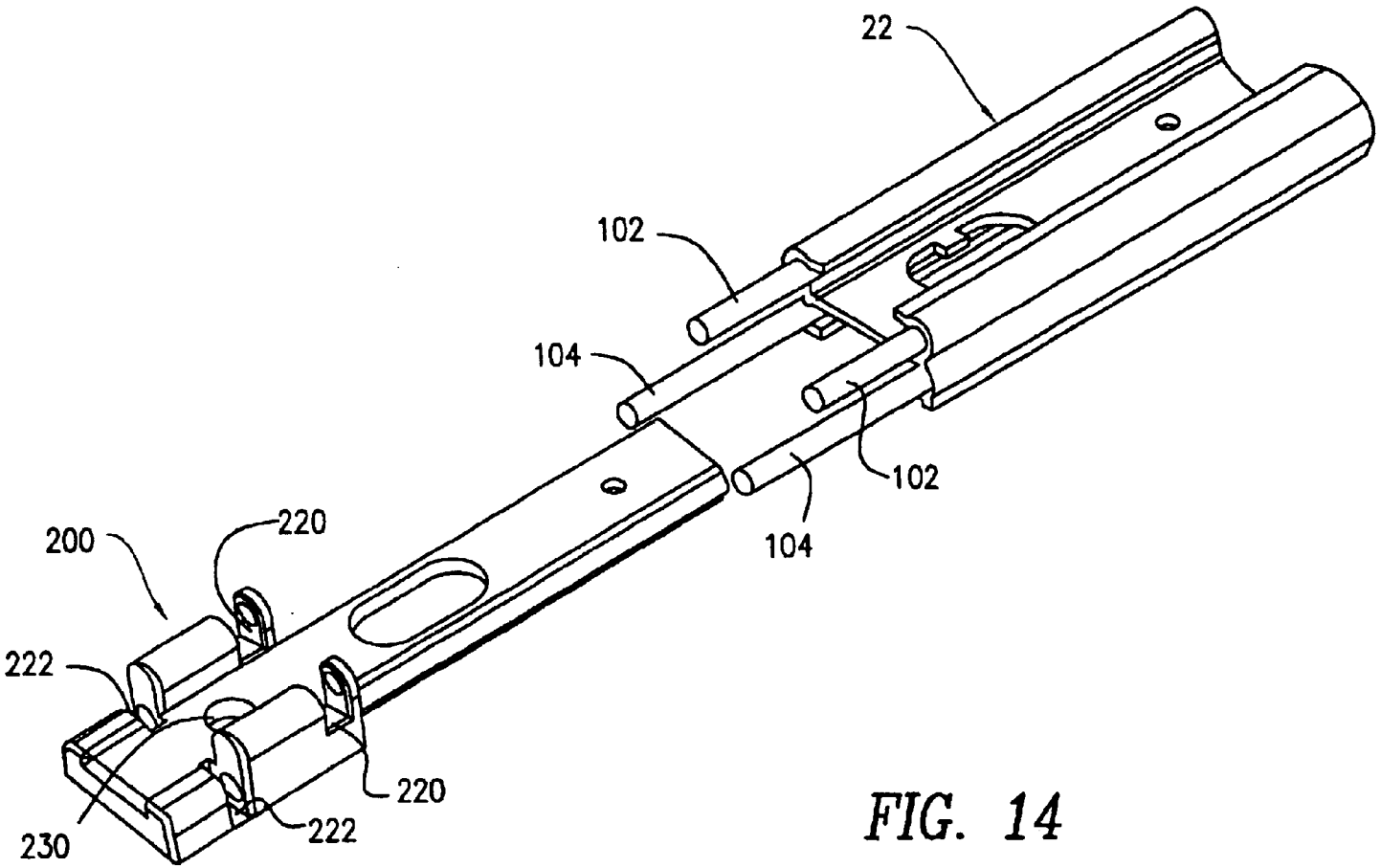
FIG. 14 is a track section joined with the base components.

As shown in FIGS. 12 to 14, at each end of track section 22, there is a base component 200 mounted on the exposed ends 102 and 104 of the track conductors 34 and 36, respectively. Base component 200 is generally U-shaped and has four axial passageways 210 to slidably receive and insulate the track conductor ends 102 and 104. There are four openings or transverse slots 220 and 222 to provide limited access to the track conductors 34 and 26. Upper track conductors 34 are shorter in length than lower track conductors 36 to ensure that contact with either the upper or lower conductors is possible when connecting track sections 22 end-to-end.

Figure 15:
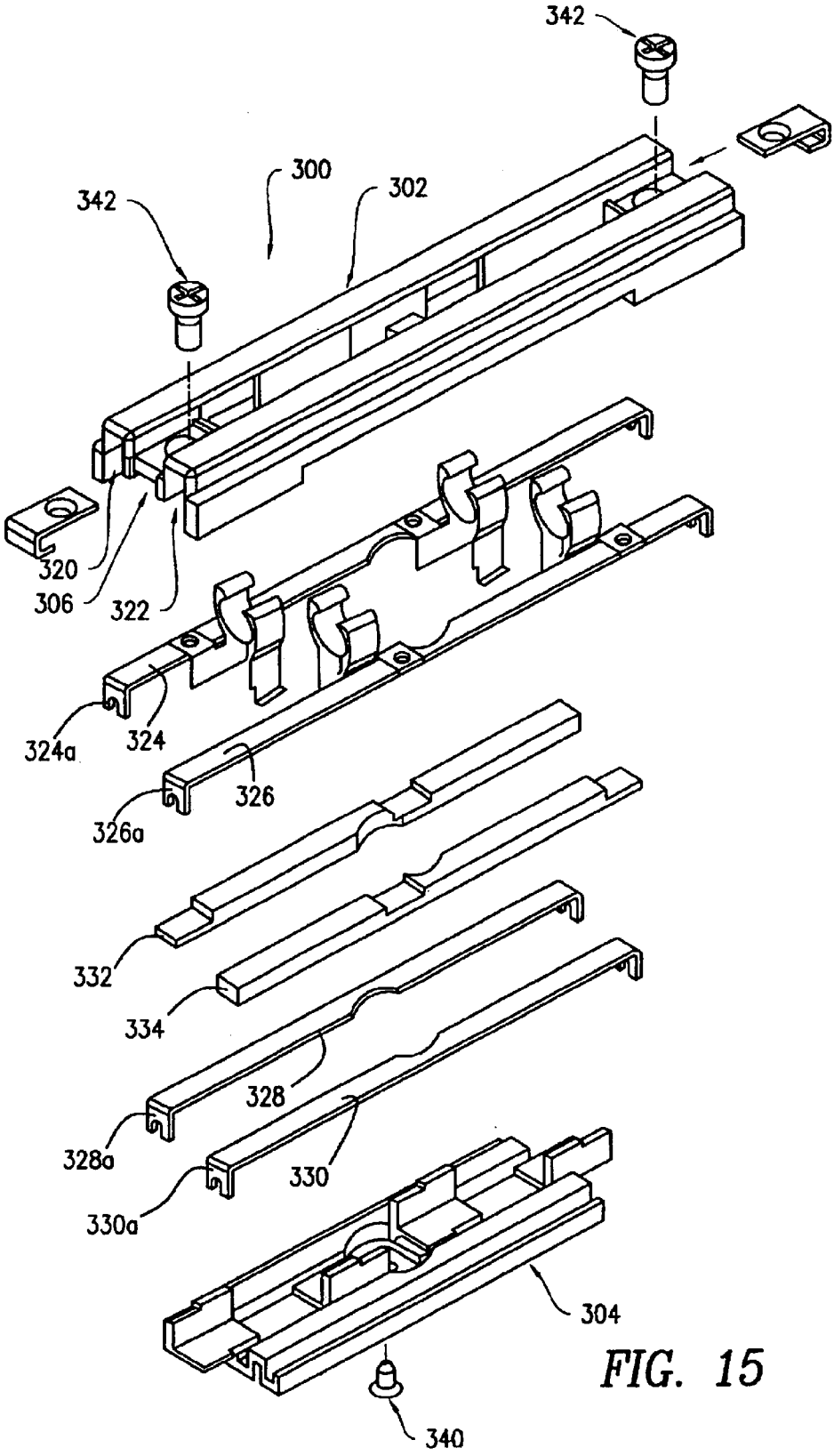
FIG. 15 is an exploded view of a track connector.
Figure 16:
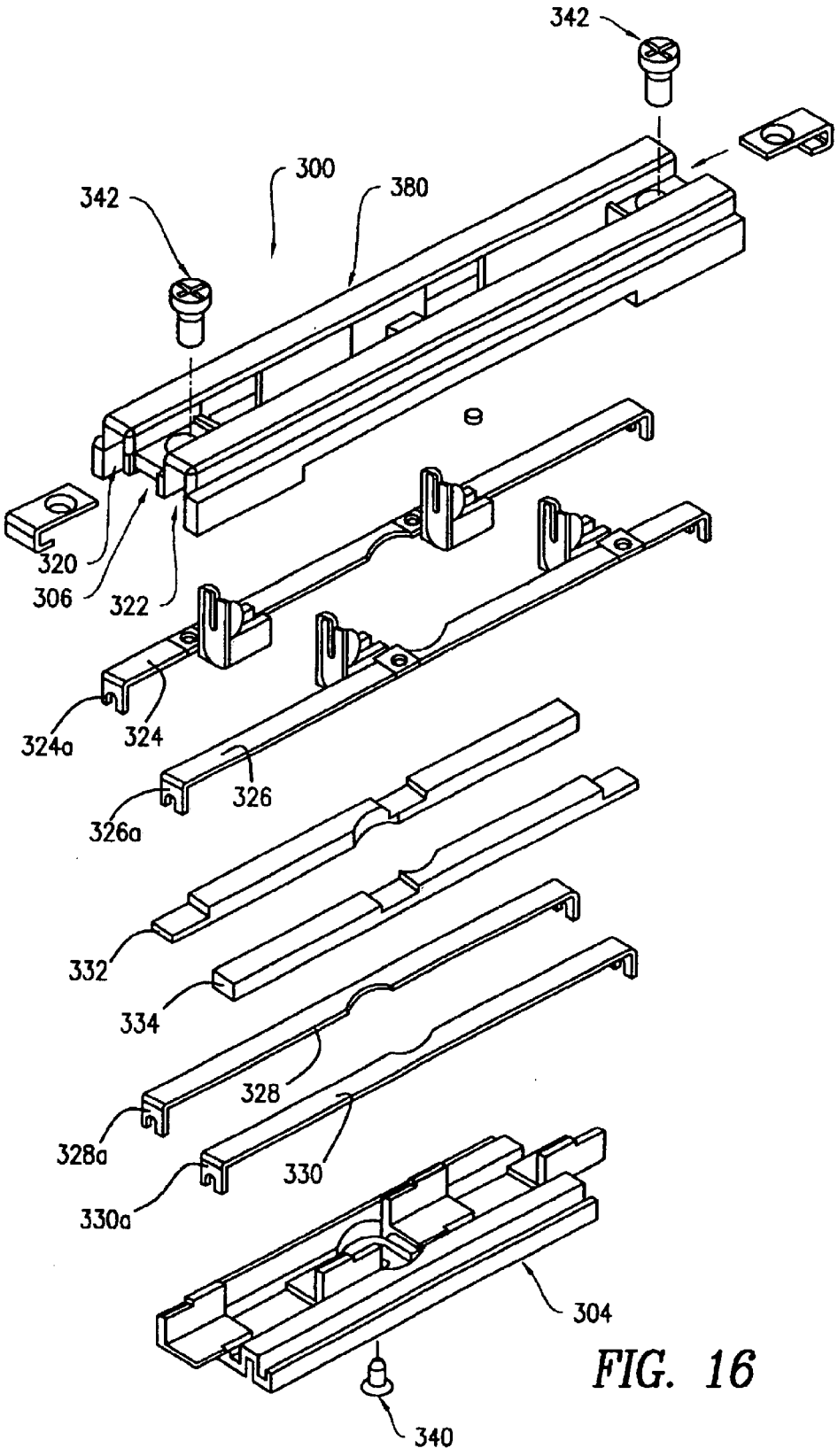
FIG. 16 is an exploded view of a track connector.

As shown in FIGS. 15 and 16, there is a track connector 300 which is attached to the base component 200 at each track end to form the electrical connections between adjacent track sections 22*a* and 22*b*. Track connector 300 is elongated and has an upper body member 302 and a lower body member 304. It is formed with a pair of spaced-apart channels 320 and 322 extending longitudinally along an underside surface 306 of the track connector 300. Housed in channels 320 and 322, there are two sets of conductor strips which include a pair of upper conductors 324, 326 and a pair of lower conductors 328, 330. Their ends 324*a*, 326*a*, and 328*a*, 330*a* make contact with the track conductor ends 102, 104, respectively. Each conductor strip end is formed with a U-notch 106 to assist in gripping the upper and lower track conductors 34 and 36, as well as to increase the surface area available for making the electrical connection. A pair of insulator strips 332, 334 are also provided. Lower body member 304 covers the conductor strips 328 and 330, leaving exposed only the conductor strip ends 324*a*, 326*a* and 328*a* and 330*a*. The conductor strips 324, 326 and 328, 330 are held in the channels 320, 322 by a screw 340, which also secures lower body member 304 to upper body member 302. Contact screws 342 are also provided.

Base component 200 includes a central screw insert 220 to provide a secure location for attaching the track connector 300 to track sections 22*a* and 22*b*. At each end of track connector 300, there is a hole 360 which is aligned with the screw insert 230 of base component 200. The end of the track connector 300 is positioned over the base components 200, bringing into alignment the conductor strip ends 324*a*, 326*a* and 328*a*, 330*a* with the slots 220 and 222. Contact between the conductor strip ends 324*a*, 326*a* and track conductor ends 102 is made within slots 220, and contact between conductor ends 328*a*, 330*a* and track conductor ends 104 is made within slots 222. Contact screws 342 are tightened to attach track connector 300 to each of the base components 200 to ensure that sufficient pressure is transferred between conductor strips 324, 326 and 328, 330 and the track conductors 34 and 36 to provide a secure electrical connection.

Track connector 300 has apertures 370 formed thereon, like the apertures 37 in track section 22, spaced apart 2 inches (50.8 millimeters) or 3 inches (7.2 millimeters) on center, depending on the length of lamp to be installed. Each aperture 370 includes a complementary set of transverse tabs 372 formed on a perimeter 374 of the aperture 370. Tabs 372 are formed in pairs, each tab being spaced apart and opposite one another to engage corresponding apertures of a lamp clip in order to lock the lamp clip in place on track connector 300.

Track connector 300 incorporates a low-profile design featuring stepped ends 310 and 312 and conductor strips 324, 326 and 328, 330. Various conductor configurations are possible to form the connection with the track conductors 34 and 36, thus providing greater lighting flexibility over existing linear lighting systems. As shown in FIG. 7, track connector 300 is in the form of a cross over connector 380, so that power is taken from the lower conductors 36 of track section 22*a* and transferred to the upper conductors 34 of track section 22*b*. In this manner, the first circuit in track section 22*a* is coupled to the second circuit in track section 22*b*.

Track connector 300 is in the form of a through connector, so that power is transferred from upper conductors 36 of one track section 22*a* to upper conductors 36 of another track section 22*b*. In this manner, the first circuit in track section 22*a* is coupled to the first circuit in track section 22*b*.

Other configurations could include taking power from the lower conductors 36 of track section 22*a* to the lower conductors 36 of track section 22*b*.

Besides forming a continuous length of track with track sections 22*a* and 22*b* in these instances, track connectors 300 also accept lamp clips, so that a continuous line of lamps can be installed from one track section over the track connector 300 to the next track section without interruption at the point of connection.

There are two distinct ways in which the track assembly 20 of the present invention may be used. First, it can be used as a combined lighting strip and power-feed system. In this arrangement, the upper set of conductors 34 of track section 22*a* are used to supply power to double-ended lamps installed on this track section, while the lower set of conductors 36 of track section 22*a* may carry current to either the upper conductors 34 or the lower conductors 36 of track section 22*b*. This allows each track section to carry a load up to its maximum allowable current rating, thus doubling the length of track typically available from a single transformer or power source.

In the second application, the track assembly 20 can be used as a twin circuit lighting track in which both the upper and the lower sets of conductors supply power to double-ended lamps. For example, two separate circuits intended for different applications can be operated off a single track section. In this case, the lamps in the first circuit are attached with lamp clips 60, while the lamps in the second circuit are attached with lamp clips 74.

Figure 17:
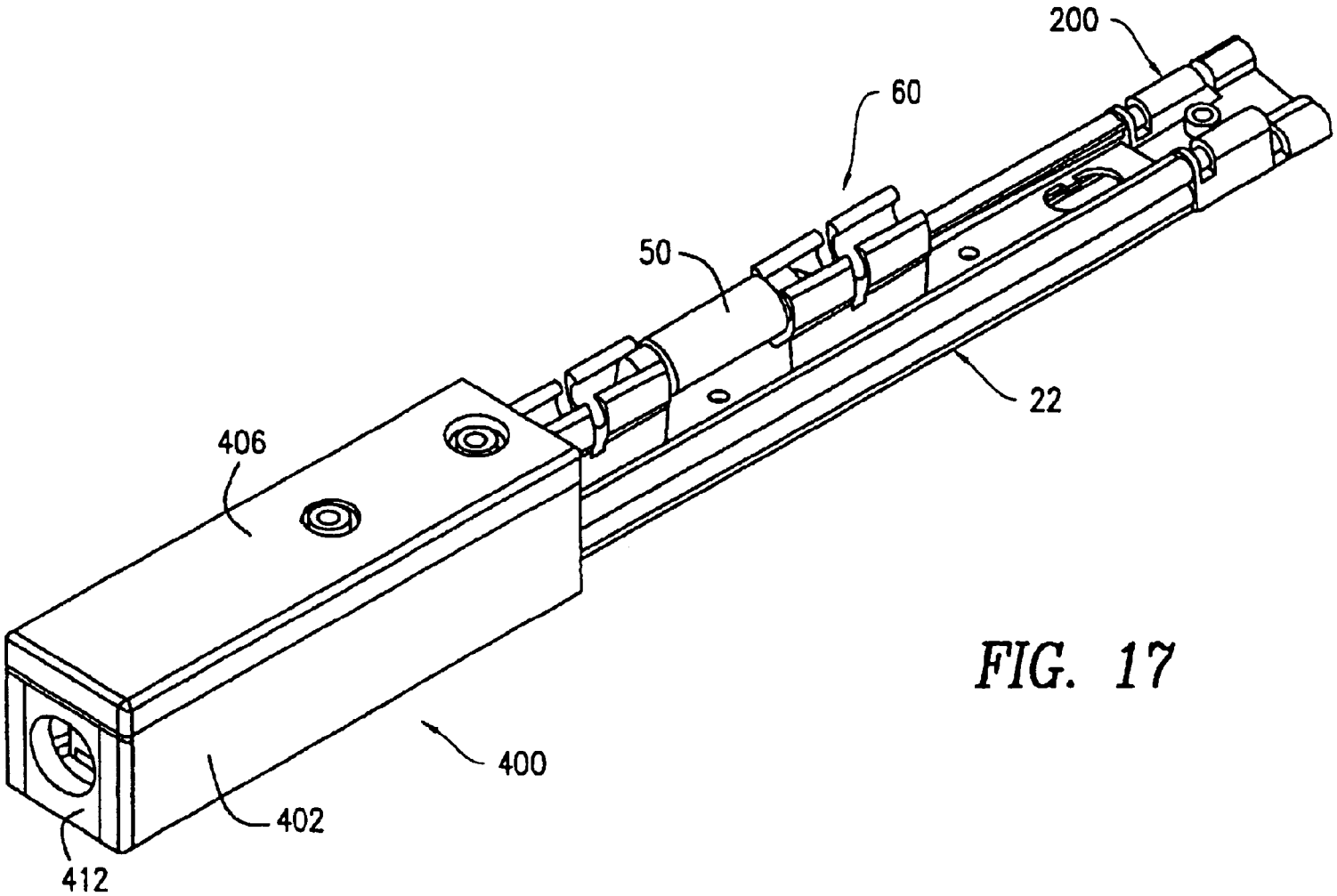
FIG. 17 is a perspective view of the power-feed connector.
Figure 18:
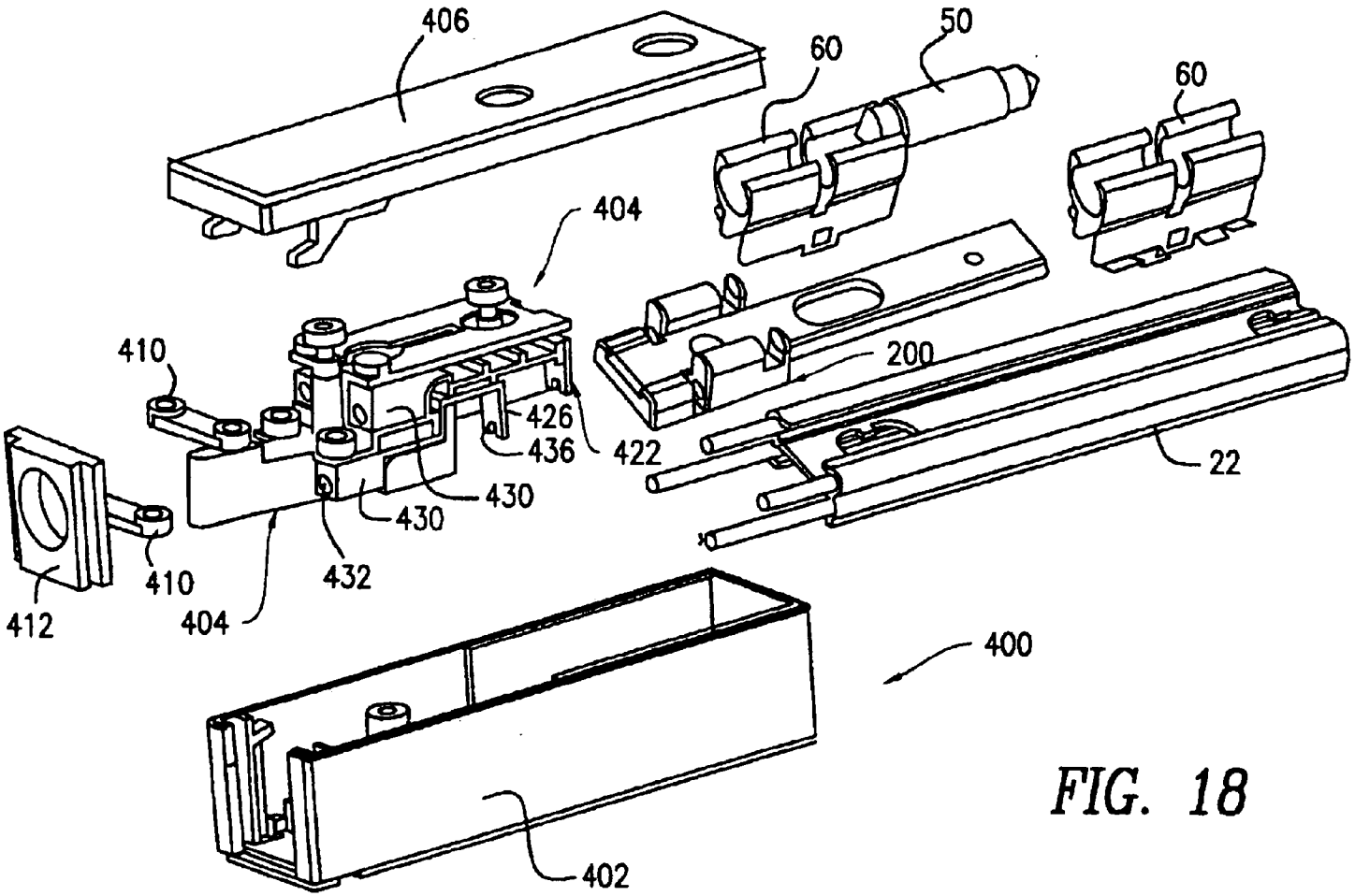
FIG. 18 is a perspective view of the power-feed connector.
Figure 19:
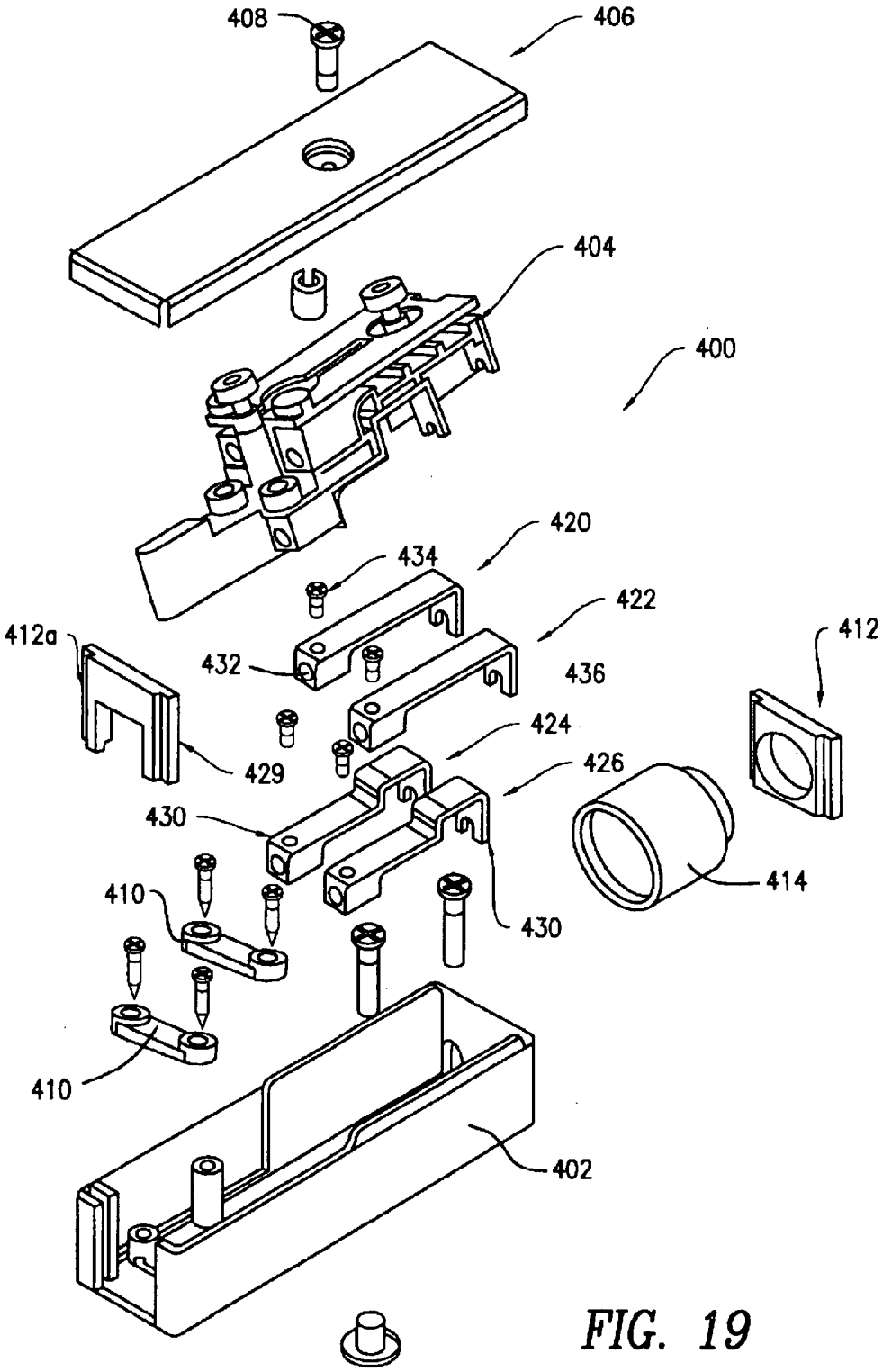
FIG. 19 is an exploded view of the power-feed connector.

FIGS. 17 to 19 show a power-feed connector 400 in accordance with the present invention. Power-feed connector 400 includes a housing 402, an insulating terminal block 404, a cover 406, and four contact tangs 420, 422 and 424, 426. Terminal block 404 has spaces to receive the contact tangs 420, 422 and 424, 426, each of the contact tangs being electrically insulated from one another within the insulating block 404. There is a terminal 430 at one end of each contact tang which provides the live end connections for securing two sets of power-supply cables thereto. Terminals 430 each include lead conductor entry holes 432 and a terminal screw 434. The other end of contact tangs 420, 422 and 424, 426 are formed into a U-notch 436 to assist in gripping the track conductors 34 and 36. U-notch also increases the surface area available for making the electrical connection. Housing 402 and cover 406 are secured together with screw 408. Inside housing 402, there are two straps 410 to prevent inadvertent removal of the power-supply cables from the power-feed connector 400. Housing 402 also has a removable sliding plate 412 to open and close the open end of housing 402. A sleeve 414 is connected to plate 412 to receive the power-supply cables.

In this manner, power is transferred from a power source, such as a transformer, by power-supply cables to holes 432 of the four contact tangs 420, 422, 424, and 426. The contact tangs transmit the power to track conductors 34, 36. When a different type of supply cable is used, an alternate sliding plate 412*a* may be slid into place to accommodate the different size or shape of power-supply cable.

Track housing 28, track connector 300, power-feed connector 400, and base components 200 are made of a material or combination of materials having electrical insulating properties. In addition, they are thermally benign with no melting of the component parts from the heat generated by the lamps or by any overload occurring during operation. Preferred materials of construction include plastic.

OPERATION OF THE INVENTION

The lighting track assembly 20 is mounted in a conventional manner (not shown) on a wall or ceiling surface, or any flat surface where light is needed to achieve a particular effect. Installation is permanent with fasteners or adhesive suitable for supporting the maximum weight of the system. To start a run of track, join the power-feed connector 400 with track section 22, surface mount them to the ceiling, and attach power-supply cables to the power-feed connector 400. Track sections can be surface mounted individually or joined together to form continuous runs of any length limited by the maximum capacity of the system. If more than one length of track section is needed, a track connector 300 is used for each additional section.

To connect the lamp, the user manually squeezes legs 64 and 66 of lamp clip 60 toward each other and places the lamp clip on the track into one of the openings 37 so that the tab 38 is aligned with a corresponding aperture 71 in the leg.

The user then releases the lamp clip, and the legs spring back, causing the tabs 38 to enter apertures 71, thereby locking the lamp clip 60 on the track. As the lamp clip is locked in position relative to the track, tang 72 is spring loaded into contact with the track conductor 34.

The first lamp clip can be snapped in place at any of the openings 37 positioned along the length of the track. As shown in FIG. 3, the tang 72 makes electrical contact only with the right-hand conductor 34 and is electrically isolated from the other conductor 34, as well as from the lower conductors 36.

The user then attaches the second lamp clip to the track in like manner as the first lamp clip, except that the second lamp clip is rotated 180 degrees from the orientation of the first lamp clip before it is installed. This places tang 72 of the second lamp clip in position to make electrical contact with the other upper conductor 34, the left-hand conductor 34 shown in FIG. 3. The second lamp clip is electrically isolated from the right-hand conductor 34 and both lower conductors 36. The first and second lamp clips are attachable to the track in distinct first and second orientations relative to each other, such that when the lighting track assembly 20 is connected to a power supply and energized, the first and second lamp clips will receive voltages of different polarity.

With respect to lamp clip 100, the user manually squeezes legs 102 and 104 toward each other and inserts leg 102 into one of the openings until the tabs 38 are aligned with apertures 122. When released, legs 102 and 104 spring back, causing tabs 38 to enter the apertures 122, thereby locking the lamp clip 100 on the track. As the lamp clip is locked in position relative to the track, the tangs are spring loaded into contact with one of the track conductors. As shown, tang 132 makes electrical contact only with the right-hand conductor and is electrically isolated from the other conductor.

The openings 37 are spaced longitudinally by a distance corresponding to the length of lamp 50. A terminal end 52 of lamp 50 is inserted into gripping section 92 of the first lamp clip, and the second terminal end 52 of lamp 50 is inserted into gripping section 92 of the second lamp clip. The terminal ends of the next lamp are inserted into gripping sections 90 of the second and third lamp clips. Additional lamp clips can be added at different positions along the track to connect more lamps as required, and the process continues until all lamps are installed. A series of such connections can be made along the length of track, provided that consecutive lamp clips are installed in alternate succession, so that adjacent lamp clips do not contact the same conductor to ensure alternating polarities with each lamp.

In a typical operation, a transformer having two circuits is used, one being a 24-volt circuit and the other a 12-volt circuit. Alternatively, two 24-volt circuits may be used, one circuit providing power for 20 feet of track and the second circuit providing power for another 20 feet of track, both from the same transformer. These two circuits are connected by a cross-over track connector 300 which transfers current from the bottom conductors in the lower circuit to the top conductors in the upper circuit. In this manner, two 25 amp circuits are powered from the same transformer. Thus, in the first 20 feet of track, there is current in both the upper and lower circuits, but only the upper circuit has the lamps on. In the second 20 feet of track, there is current only in the upper circuit and not in the lower circuit, so current is supplied to the lamps in the second 20 feet of track.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A lighting fixture assembly, comprising:

a) at least one lighting track including an elongated housing defining at least two channels extending in a direction along the longitudinal axis of said housing;

b) at least two conductors mounted in said channels to form at least one electrical circuit;

c) a plurality of lamp clips for receiving lamps mounted on said lighting track, said lamp clips each having first and second legs for connecting said lamp clip to said lighting track and each having a socket receiving the terminal end of a lamp;

d) locking means for locking each of said first and second legs at a predetermined location on said lighting track;

e) said locking means include a plurality of complementary tabs extending in the plane of said housing at predetermined locations along the length of said housing; and a longitudinal extension formed on each of said first and second legs at an end opposite said socket, said extensions each having an aperture for receiving one of said complementary tabs, whereby each of said first and second legs is locked in position relative to the track as each of said tabs engages the corresponding aperture; and f) contact means for making electrical contact between the lamp and one of said conductors, said electrical contact means being separate from said locking means.

2. A lighting fixture assembly in accordance with claim 1, further including a second set of channels and a second set of conductors mounted therein to form a second electrical circuit.

3. A lighting fixture assembly in accordance with claim 1, wherein said housing has a plurality of openings, each opening having a set of said complementary tabs formed on the perimeter thereof, the tabs of said set of complementary tabs being spaced-apart and opposite one another to engage the corresponding apertures of said first and second legs.

4. A lighting fixture assembly in accordance with claim 1, wherein there is a first set of said conductors mounted in a first set of said channels in spaced-apart relationship on the upper plane surface of said housing for forming a first electrical circuit, and wherein there is a second set of said conductors mounted in a second set of said channels in spaced-apart relationship on the lower plane surface of said housing for forming a second electrical circuit.

5. A lighting fixture assembly in accordance with claim 1, wherein said lamp clips each include two lamp-receiving sockets for receiving the terminal ends of lamps therein.

6. A lighting fixture assembly in accordance with claim 5, wherein said electrical contact means comprises an electrical extension attached to one of said legs, said electrical extension projecting outwardly from said leg and having a surface for making electrical contact with one of said conductors.

7. A lighting fixture assembly in accordance with claim 1, wherein each of said lamp clips is formed from a strip of resilient metallic material.

8. A lighting fixture assembly in accordance with claim 7, comprising means for supplying power to said lighting track.

9. A lighting fixture assembly in accordance with claim 1, further including a power-feed connector including:

a) a terminal block having means for securing at least one set of power-supply cables to said terminal block; and b) said terminal block including conductive strips for connection to said at least two conductors at one end of said lighting track.

10. A lighting fixture assembly in accordance with claim 9, wherein said terminal block includes a plurality of axial passageways, each passageway for slidably receiving one of said conductors.

11. A lighting fixture assembly in accordance with claim 9, wherein said terminal block includes a plurality of electrical contact tangs, each of said electrical contact tangs having a terminal at one end thereof for securing one lead of said power cable, an opposite end of said contact tang being adapted to make electrical contact with one of said track conductors.

12. A lighting fixture assembly in accordance with claim 1, further including means for making an end-to-end connection of said lighting tracks.

13. A lighting fixture assembly in accordance with claim 12, wherein there are two lighting tracks and said end-to-end connection means comprises:

a) a base component attached to said at least two conductors at one end of each lighting track;

b) a track connector attached at opposite ends to said base component, said track connector comprising an elongated housing defining a pair of longitudinal channels in spaced-apart relationship; and c) a conductive strip mounted in each of said channels of said track connector, each end of said conductive strip having a surface for making electrical contact with a conductor in one of said lighting tracks.

14. A lighting fixture assembly in accordance with claim 13, wherein said base component includes a plurality of axial passageways, each passageway slidably receiving one of said conductors and having an opening for allowing said conductive strip to make contact with one of said conductors.

15. A lighting fixture assembly in accordance with claim 14 wherein there are a first set and second set of conductors in each of said lighting tracks, wherein one end of each conductive strip makes electrical contact with a corresponding conductor in said second set of conductors of one lighting track, and the other end of each conductive strip makes electrical contact with a corresponding conductor in said first set of conductors of the other lighting track.

16. A lighting fixture assembly in accordance with claim 14 wherein there are a first set and second set of conductors in each of said lighting tracks, wherein one end of each conductive strip makes electrical contact with a corresponding conductor in said first set of conductors of one lighting track, and the other end of each conductive strip makes electrical contact with a corresponding conductor in said first set of conductors of the other lighting track.

17. A lighting fixture assembly in accordance with claim 14, wherein said track connector includes a plurality of complementary tabs extending in the plane of said track connector at predetermined locations along the length of said track connector, said complementary tabs being spaced apart and opposite one another to engage corresponding apertures of a lamp clip.

18. A lighting fixture assembly in accordance with claim 17, wherein said track connector has a plurality of openings, each opening having a set of said complementary tabs formed on the perimeter thereof, the tabs of said set of complementary tabs being spaced apart and opposite one another to engage corresponding apertures of a lamp clip.

19. A lighting track, comprising:

a) an elongated housing defining a plurality of channels extending in a direction along the longitudinal axis of said housing, said channels positioned both above and below a designated reference plane of said housing;

b) a plurality of conductors mounted in said channels along an upper plane surface of said housing;

c) a plurality of conductors mounted in said channels along a lower plane surface of said housing;

d) means for engaging a plurality of lamp clips for receiving lamps; and e) said engaging means includes a plurality of complementary tabs extending in the plane of said housing at predetermined locations along the length of said housing, said complementary tabs being spaced apart and opposite one another to engage corresponding apertures of a lamp clip.

20. A lighting track in accordance with claim 19, wherein said housing has a plurality of openings, each opening having a set of said complementary tabs formed on the perimeter thereof to form said engaging means, the tabs of said set of complementary tabs being spaced apart and opposite one another to engage corresponding apertures of a lamp clip.

21. A lighting track in accordance with claim 19, wherein there are a first set of conductors mounted in a first set of channels in spaced-apart relationship on the upper plane surface of said housing, and a second set of conductors mounted in a second set of channels in spaced-apart relationship on the lower plane surface of said housing.

22. A lighting track in accordance with claim 21, comprising a base component attached to said first set and said second set of conductors at one end of said lighting track, said base component including a plurality of axial passageways, each passageway for receiving one of said conductors and having an opening for allowing access to make electrical contact with the conductor.

23. A lighting fixture system, comprising:

a) at least two lighting tracks connected to each other end-to-end, each lighting track including an elongated housing defining a plurality of channels extending in a direction along the longitudinal axis of said housing;

b) a first set of said conductors mounted in a first set of said channels in spaced-apart relationship on the upper plane surface of said housing in order to form a first electrical circuit;

c) a second set of said conductors mounted in a second set of said channels in spaced-apart relationship on the lower plane surface of said housing in order to form a second electrical circuit;

d) means for engaging a lamp clip at a predetermined location on said lighting tracks;

e) a base component attached to said first set and said second set of conductors at one end of each lighting track; said base component includes a plurality axial passageways, each passageway for receiving one of said conductors and having an opening for allowing a conductive strip in said base component to make electrical contact with one of said conductors;

f) a track connector attached at opposite ends to each of said base components, said track connector including an elongated housing defining a pair of longitudinal channels in spaced-apart relationship; said track connector including a plurality of complementary tabs extending in the plane of said track connector at predetermined locations along the length of said track connector, said complementary tabs being spaced apart and opposite one another to engage corresponding apertures of a lamp clip; and g) a conductive strip mounted in each of said channels of said track connector, each end of said conductive strip having a surface for making electrical contact with a conductor in one of said lighting tracks.

24. A lighting track system in accordance with claim 23, wherein said track connector has a plurality of openings, each opening having a set of said complementary tabs formed on the perimeter thereof, the tabs of said set of complementary tabs being spaced apart and opposite one another to engage corresponding apertures of a lamp clip.

25. A lighting track system in accordance with claim 23, wherein one end of each conductive strip makes electrical contact with a corresponding conductor in said second set of conductors of one lighting track, and the other end of each conductive strip makes electrical contact with a corresponding conductor in said first set of conductors of the other lighting track.

26. A lighting track system in accordance with claim 23, wherein one end of each conductive strip makes electrical contact with a corresponding conductor in said first set of conductors of one lighting track, and the other end of each conductive strip makes electrical contact with a corresponding conductor in said first set of conductors of the other lighting track.

27. An electrical lamp clip for a double-ended lamp of a lighting track system, comprising:

a) a body having first and second legs for supporting the lamp clip on a lighting track and a socket connected to said first and second legs for receiving a terminal end of a lamp;

b) means for locking each of said first and second legs on the lighting track; said locking means includes a longitudinal extension formed on each of said first and second legs at an end opposite said socket, said extensions each having an aperture for receiving a corresponding tab of a set of complementary tabs located on the lighting track, whereby each leg is locked in position relative to the lighting track as each tab engages the corresponding aperture; and c) means for making electrical contact between the lamp and a current-carrying conductor in the lighting track, said electrical contact means being separate from said locking means.

28. An electrical lamp clip in accordance with claim 27, wherein said body is formed from a strip of resilient metallic material.

29. An electrical lamp clip in accordance with claim 27, wherein said electrical contact means comprises an electrical extension attached to one of said legs, said electrical extension projecting outwardly from said leg and having a surface for making electrical contact with a conductor in the lighting track.

30. An electrical lamp clip for a double-ended lamp of a lighting track system, comprising:

a) a body formed from a strip of resilient metallic material;

b) said body having first and second legs for supporting the lamp clip on a lighting track and a socket connected to said first and second legs for receiving a terminal end of a lamp;

c) each of said first and second legs having a longitudinal extension formed thereon at an end opposite said socket;

d) said longitudinal extensions each having an aperture for the reception of a corresponding tab of a set of complementary tabs located on the lighting track, whereby each leg is locked in position relative to the lighting track as each tab engages the corresponding aperture; and e) an electrical extension on one of said legs, said electrical extension projecting outwardly from said leg and having a surface for making electrical contact with a conductor in the lighting track to establish an electrical path between the lamp clip and the conductor.

31. An electrical lamp clip in accordance with claim 30, wherein said first leg has electrical contact means thereon, so that when the lamp clip is locked in position on the track, said first leg makes electrical contact.

32. An electrical lamp clip in accordance with claim 30, wherein each of said first and second legs has an aperture formed therein for the reception of a corresponding tab of a set of complementary tabs located within the plane of the lighting track, whereby each leg is locked in position relative to the track as each tab engages the corresponding aperture.

33. An electrical lamp clip in accordance with claim 32, wherein said second leg includes a longitudinal extension formed thereon at an end opposite said socket, said extension having the aperture for reception of the tab.

34. An electrical lamp clip in accordance with claim 30, wherein the apertures formed in each of said first and second legs are equidistant from said socket.

35. An electrical lamp clip in accordance with claim 34, wherein said electrical contact means comprises a tang attached to said first leg at an end opposite said socket, said tang projecting outwardly therefrom and having a surface for making electrical contact with a conductor in the track.

* * * * *